US006127780A

United States Patent [19]

Winsor

[11] Patent Number: 6,127,780

[45] Date of Patent: Oct. 3, 2000

[54] WIDE ILLUMINATION RANGE PHOTOLUMINESCENT LAMP

[75] Inventor: Mark D. Winsor, Seattle, Wash.

[73] Assignee: Winsor Corporation, Tumwater, Wash.

[21] Appl. No.: 09/017,263

[22] Filed: Feb. 2, 1998

[51] Int. Cl.[7] ..... H01J 1/62

[52] U.S. Cl. ..... 315/56; 315/169.4; 313/493; 313/634

[58] Field of Search ..... 315/169.3, 169.4, 315/160, 168, 167, 172, 175, 94, 98, 106, 107, 56; 313/493, 494, 573, 574, 638, 639

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |
| 4,698,547 | 10/1987 | Grossman et al. | 313/485 |

(List continued on next page.)

FOREIGN PATENT DOCUMENTS

| | | |
|---|---|---|
| 0 066 495 A2 | 12/1982 | European Pat. Off. . |
| 0 329 226 A1 | 8/1989 | European Pat. Off. . |
| 0 550 047 A2 | 7/1993 | European Pat. Off. . |
| 89 04 853 U | 8/1989 | Germany . |

(List continued on next page.)

OTHER PUBLICATIONS

Mercer et al., "Fluorescent backlights for LCDs," *Information Display*: Nov. 8–13, 1989.

Sanyo Electric Co., Ltd., "Flat Fluorescent Lamp Specifications."

Hinotani et al., "Flat Fluorescent Lamp for LCD Back–Light," *1988 International Display Research Conference*.

*Primary Examiner*—David Vu

*Attorney, Agent, or Firm*—Michael J. Donohue; Seed IP Law Group PLLC

[57] ABSTRACT

A flat photoluminescent lamp has external walls and a plurality of internal walls designed to form a serpentine channel having first and second ends. First and second electrodes, positioned in proximity with the first and second ends of the serpentine channel generate a plasma discharge therebetween in response to the application of power to the electrodes. A heater element, comprising a thick film cermet material is disposed on the bottom external surface of the lamp. The heater element is serpentine in shape and substantially follows the path of the serpentine channel. Disposed on opposite sides of the heater element are serpentine conductors, also comprising a thick film cermet material. A DC voltage is applied to the heater element to maintain the internal temperature of the lamp at a desired temperature value. A temperature sensing element may also be used to control the power applied to the heater element. For operation in a low intensity mode, an AC signal is applied to the serpentine conductors causing the generation of an electric field within the interior portion of the lamp throughout the serpentine channel. A low level electric discharge field within a serpentine channel results in the generation of visible light at low intensity levels.

33 Claims, 5 Drawing Sheets

U.S. PATENT DOCUMENTS

| | | | |
|---|---|---|---|
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,837,519 | 6/1989 | Lopetrone et al. | 324/529 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Winsor | 315/169.4 |
| 5,343,116 | 8/1994 | Winsor | 313/493 |
| 5,420,481 | 5/1995 | McCanney | 315/291 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,616,989 | 4/1997 | Taillie et al. | 315/32 |
| 5,645,337 | 7/1997 | Gleckman | 362/29 |
| 5,818,164 | 10/1998 | Winsor | 313/493 |
| 5,841,230 | 11/1998 | Ikoma et al. | 313/506 |
| 5,850,122 | 12/1998 | Winsor | 313/493 |
| 5,903,095 | 5/1999 | Yoshida | 313/485 |
| 5,903,096 | 5/1999 | Winsor | 313/493 |
| 5,914,560 | 6/1999 | Winsor | 313/493 |

FOREIGN PATENT DOCUMENTS

| | | |
|---|---|---|
| 39 22 865 A1 | 1/1991 | Germany . |
| 43 13 017 A1 | 12/1994 | Germany . |
| 60-216435 | 10/1985 | Japan . |
| 62-208536 | 9/1987 | Japan . |
| 1017374 | 1/1989 | Japan . |
| 64-17374 | 1/1989 | Japan . |
| 1206553 | 8/1989 | Japan . |
| 2-72552 | 3/1990 | Japan . |
| 2-78147 | 3/1990 | Japan . |
| 3-46748 | 2/1991 | Japan . |
| 3-129659 | 6/1991 | Japan . |
| 3-222253 | 10/1991 | Japan . |
| 3-285249 | 12/1991 | Japan . |
| 4-95337 | 3/1992 | Japan . |
| 4-147554 | 5/1992 | Japan . |
| 06251876 | 9/1994 | Japan . |
| 947340 | 1/1964 | United Kingdom . |
| 2 032 681 | 5/1980 | United Kingdom . |
| 2 217 515 | 10/1989 | United Kingdom . |
| WO 87/04562 | 7/1987 | WIPO . |
| WO 92/02947 | 2/1992 | WIPO . |

WIDE ILLUMINATION RANGE PHOTOLUMINESCENT LAMP

TECHNICAL FIELD

The present invention is related generally to planar photoluminescent lamps, and, more particularly, to planar photoluminescent lamps having a wide illumination range.

BACKGROUND OF THE INVENTION

Planar fluorescent lamps are useful in many applications, including backlights for displays such as liquid crystal displays. A common weakness in such fluorescent lamps is their limited illumination range.

Planar fluorescent lamps typically utilize an electric plasma discharge through a low pressure mercury vapor and buffer gas to produce ultraviolet radiation. The ultraviolet radiation strikes a fluorescent material which converts the ultraviolet radiation to visible light. To produce the low pressure plasma discharge, such lamps typically require a substantial minimum energy input. If the lamps are driven below the minimum energy input, the plasma discharge may not be formed, or may be highly non-uniform. Moreover, the efficiencies of such lamps can be degraded substantially at low level operation. To improve uniformity and efficiency, such lamps typically must be driven well above their minimum energy input levels so that a complete, uniform plasma discharge can be formed. At such high energy levels, the lamp emits a substantial amount of light, typically in a range exceeding 100 foot-lamberts or 342 candles per square meter (cd/m$^2$).

While such light intensities may be useful in relatively high ambient light applications, in some applications such a high level of light intensity can be detrimental. For example, when high intensity fluorescent lamps are used to provide illumination for nighttime displays in automobiles, high levels of light make it difficult for the driver to view objects outside of the automobile. Consequently, it is often desirable to dim the fluorescent lamps to levels well below 1.0 foot-lambert (34 cd/m$^2$).

To improve dimmability, a filter can be added to high intensity fluorescent lamps to block out some of the light. However, filtering can reduce the maximum light intensity of the lamps, rendering them ineffective in high ambient light environments or produce extra heat with less lumens per watt of power consumed by the lamp.

Therefore, it can be appreciated that there is a significant need for a planar fluorescent lamp having a wide illumination range. The present invention offers these and other advantages, as will be apparent from the following description and accompanying figures.

SUMMARY OF THE INVENTION

The present invention is embodied in a gas filled planar photoluminescent lamp. The lamp contains a photoluminescent material to emit visible light when the gas emits ultraviolet energy. The lamp comprises a lamp body and lamp cover mounted to the lamp body such that the lamp body and cover define a chamber. The chamber has a channel length extending from a first end to a second end. A first electrode is mounted in proximity with the channel first end. A second electrode is mounted in proximity with the channel second end. The first and second electrodes are configured to produce a plasma discharge therebetween along the channel length when supplied with electrical power. The photoluminescent material emits visible light when the gas emits ultraviolet energy in response to the plasma discharge. The lamp also includes first and second electrical conductors outside the chamber and distributed along at least a portion of the channel length. The first and second electrical conductors generate an electric field throughout the portion of the channel length in a direction substantially perpendicular to the channel length when supplied with electric power. The photoluminescent material emits visible light when the gas emits ultraviolet energy in response to the electric field.

In one embodiment, the lamp also includes a temperature control system located outside the chamber to control the temperature within the chamber. The temperature control system can include a resistive material mounted on the outside portion of the lamp body along at least a portion of the channel length. The resistive material generates heat in response to the application of electrical power thereto. A temperature sensing component mounted on the outside portion of the lamp body is used to sense temperature within the chamber and to generate a temperature signal indicative of the temperature within the chamber. The temperature signal is used to control the application of electrical power to the resistive material. In one embodiment, the electrical power applied to the resistive material is direct current (DC) power.

The first and second electrodes may be powered by DC electrical power or alternating current (AC) electric power.

The first and second electrodes may be hot cathode or cold cathode type electrodes. The electrodes may be mounted internally within the chamber or contained within first and second electrode modules that are externally mounted outside the chamber.

In a particular embodiment, the electrical power applied to the first and second electrical conductors is AC electrical power. The first and second electrical conductors may be substantially parallel with respect to each other along the portion of the channel length. In one embodiment, the first and second electrical conductors are distributed along the entirety of the channel length.

DETAILED DESCRIPTION OF THE INVENTION

Figure 1:
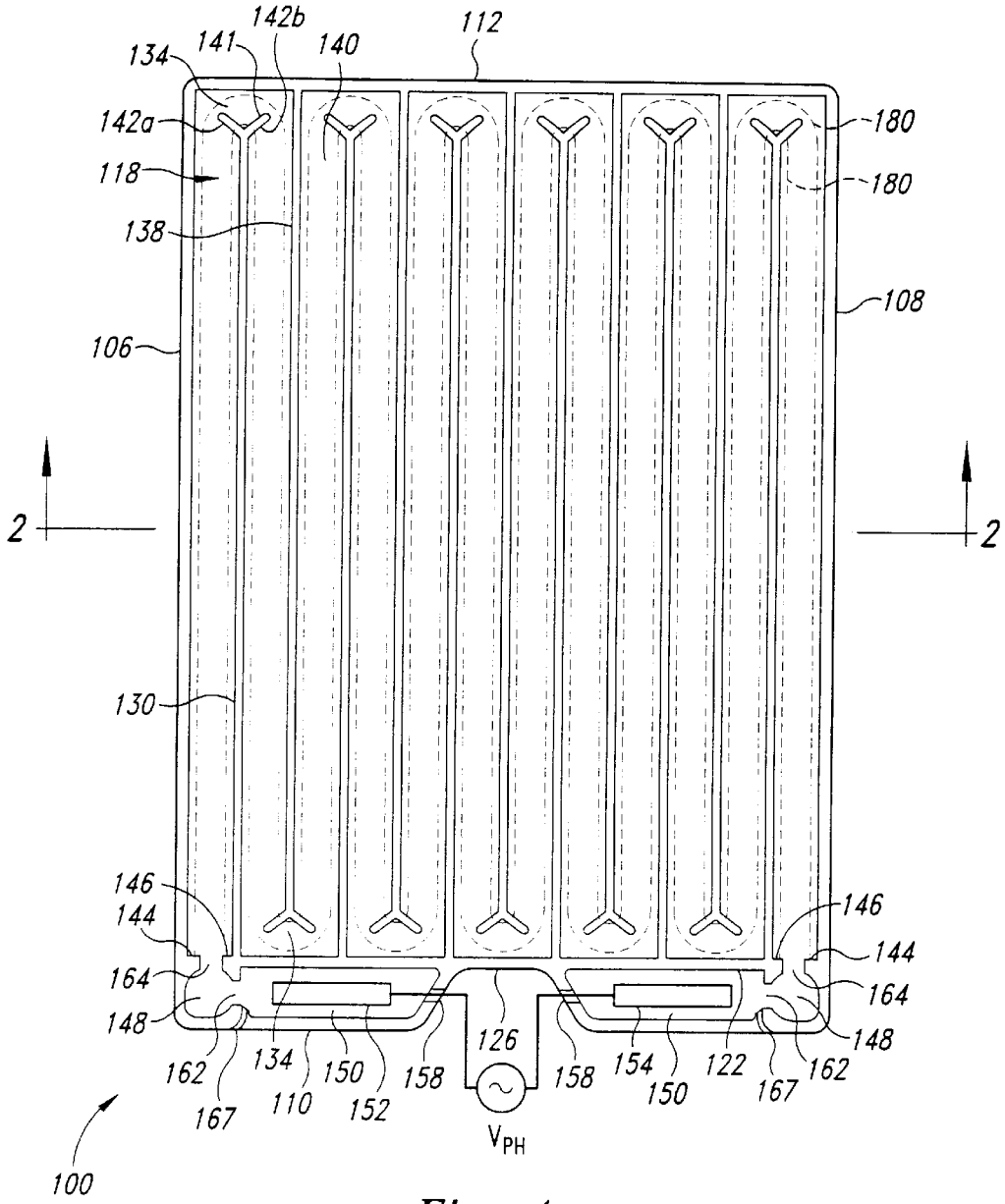
FIG. 1 is a top plan view of a lamp according to the present invention.
Figure 2:
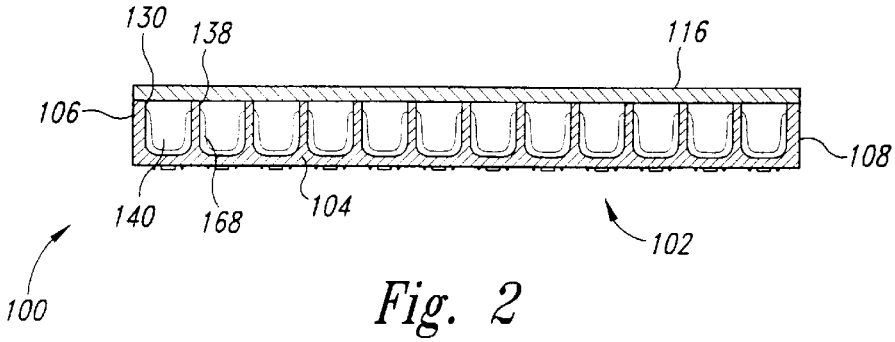
FIG. 2 is a side elevational view of the lamp of FIG. 1 taken along the line 2—2.
Figure 3:
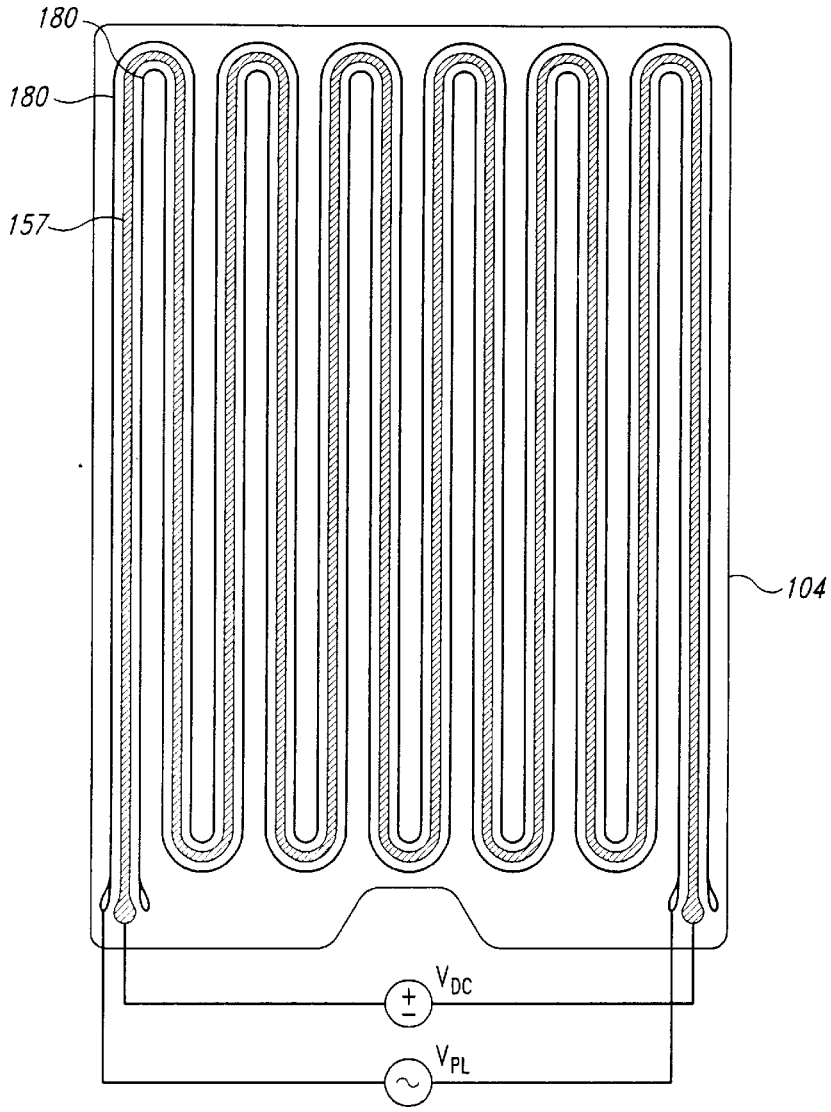
FIG. 3 is a bottom plan view of the lamp of FIG. 1.

The present invention is directed to a planar fluorescent lamp 100, shown in a first embodiment in FIGS. 1–3, and includes a lamp body 102. In a preferred embodiment, the lamp body 102 is made of transparent glass. However, the lamp body 102 may be made of other known materials such as metal. The lamp body 102 is formed from a base 104 having first and second sidewalls 106 and 108 and first and second endwalls 110 and 112 projecting upwardly therefrom to form a recess. A transparent glass lamp cover 116 overlays the recess and is bonded to the sidewalls 106 and 108 and the endwalls 110 and 112 such that the lamp body 102 and lamp cover 116 together form a sealed chamber 118.

Within the chamber 118 is a channel endwall 122, which is substantially parallel to and spaced apart from the first endwall 110. The first endwall 110 includes a curved central portion 126 that intersects the channel endwall 122.

A plurality of channel walls 130 project from the channel endwall 122 toward the second endwall 112. The channel walls 130 terminate a short distance from the second endwall 112 forming gaps 134 between the distal ends of the channel walls 130 and the second endwall 112. A complementary set of channel walls 138 extend from the second endwall 112 toward the channel endwall 122 and form similar gaps 134 at their distal ends. The channel walls 130 and 138 are spaced apart at substantially equal intervals intermediate the first sidewall 106 and the second sidewall 108 to define a serpentine channel 140. The channel walls 130 and 138 are glass walls integral to the lamp body and project upwardly from the base 104 toward the lamp cover 116.

At the distal end of each of the channel walls 130 and 138 is a guide member 141. In a preferred embodiment, the guide member 141 comprises angled fins 142*a* and 142*b*. The angled fins 142*a* and 142*b* extend from the channel walls 130 and 138 into, and partially block, the serpentine channel 140. In a preferred embodiment, the gap 134 formed near the guide member 141 is approximately 65% of the width of each channel of the serpentine channel 140. The guide member 141 is designed to guide the plasma discharge toward a central portion of the serpentine channel 140 to provide more uniform light near the gaps 134 of the serpentine channel.

One disadvantage of conventional planar lamps is the nonuniformity in the distribution of the plasma discharge in the chamber 118. The angled fins 142*a* and 142*b* of the guide member 141 advantageously force the plasma discharge into the central portion of the serpentine channel 140 resulting in a more uniform current density distribution of the plasma discharge throughout the serpentine channel, and thus providing more uniform lighting in the serpentine channel. As a result, the lamp 100 provides more uniform lighting than is possible with the conventional lamp.

The lamp 100 also includes shoulder portions 144 of the first and second sidewalls 106 and 108, which project toward the channel endwall 122. The channel endwall 122 also includes shoulder portions 146 at each end, which project toward the shoulder portions 144 of the first and second sidewalls 106 and 108. A partial circular contoured surface formed in the first and second sidewalls 106 and 108 and the first endwall 110, and a partial circular contoured surface of the shoulder 144 and the shoulder 146 define a getter space 148. Each getter space 148 is sized to retain a getter (not shown) within the plasma discharge pathway. As is well known in the art, the getter chemically interacts with and removes impurities from the gas within the chamber 118.

The first endwall 110, the channel wall 122, and the curved portion 126 of the first endwall define compartments 150. First and second electrodes 152 and 154 are cold cathode electrodes positioned within the compartments 150. Apertures 158 in the curved portion 126 of the first endwall 110 permit passage of electrical wires for external connection to the first and second cathodes 152 and 154. During assembly, conventional glass soldering techniques are used to seal the apertures 158 to provide an airtight seal.

The various sidewalls, endwalls, and channel walls are all bonded to the lamp cover 116 using known glass soldering techniques. The first and second sidewalls 106 and 108 and the first and second endwalls 110 and 112 provide a seal for the chamber 118. The channel walls 130 and 138 are bonded to the lamp cover 116 by the glass solder such that the channel walls provide insulative barriers between adjacent sections of the serpentine channel 140. The glass solder between the lamp cover 116 and the channel endwall 122 provide insulative barriers between the serpentine channel 140 and the compartments 150.

The circular portion of the first endwall 110 and the circular portion of the shoulder 146 define a passageway 162 between the getter space 148 and the compartment 150. The shoulder 144 of the first and second sidewalls 106 and 108 combine with the shoulder portion 146 of the channel endwall 122 to define a passageway 164 between the serpentine channel 140 and the getter space 148.

The first and second electrodes 152 and 154, upon electrical excitation by a power supply $V_{PH}$, produce a plasma discharge, which travels along the serpentine channel 140 between the first and second electrodes. The power supply $V_{PH}$ typically supplies a high voltage alternating current (AC) signal. However, a direct current (DC) power supply can also be used for the power supply $V_{PH}$. The current flow of the plasma discharge follows a pathway through the passageway 162, the getter space 148, the passageway 164, and the serpentine channel 140.

As is known to those of ordinary skill in the art, a very high voltage (i.e., a start voltage) is required to initiate the plasma discharge, while a somewhat lower voltage (i.e., a run voltage) is required to maintain the plasma discharge. For example, with a conventional DC power supply, the start voltage may typically be as high as 2,000 volts while the run voltage may typically be 500 volts. The conventional power supply must be capable of generating the start voltage and typically uses a resistor (not shown) to reduce the start voltage and thereby generate the run voltage. This process is undesirable because it requires a more expensive high voltage supply and is inefficient because a resistor is used to drop the voltage, thereby generating unnecessary heat. Similarly, if the power supply is a conventional AC power supply, it is necessary to generate a start voltage and a run voltage. However, as will be discussed in detail below, the present invention includes additional elements that eliminate the need for the power supply $V_{PH}$ to generate the start voltage. As a result, the power supply $V_{PH}$ is more efficient and less expensive than a conventional gas discharge lamp power supply.

A gas within the chamber 118, which may include mercury vapor, reacts to the plasma discharge and produces ultraviolet (UV) radiation in response thereto. The UV radiation is converted to visible light energy by a fluorescent layer 168 which coats the interior of the recess, including the channel walls 130 and 138, and the interior portion of the first and second sidewalls 106 and 108. The visible light energy $L_P$ emitted by the fluorescent layer 168 is transmitted to an observer through the transparent lamp cover 116.

Although mercury vapor is frequently used in fluorescent lamps, it is well known to use other gases, such as Argon, Xenon, a mixture of inert and halogen gases and the like, either alone or in combination to produce the desired spectral characteristics. In addition, it is known to vary the lamp pressure to alter the spectral characteristics of the lamp for a given gas. Furthermore, it is known to use photoluminescent materials other than phosphors to generate visible light in response to excitation by UV radiation. Accordingly, the present invention is not limited by the lamp pressure, the type of photoluminescent material, or type of gas used to fill the lamp 100.

Apertures 167 in the first end wall 110 are used to introduce the gas into the lamp 100. The evacuation of the chamber 118 and the introduction of the gas is accomplished in a well known fashion, which need not be described herein. Following the introduction of gas into the lamp 100, the apertures 167 are sealed using conventional glass soldering techniques.

It is known in the art that cold spots may form in areas within the chamber 118 where the temperature falls below 50° C. Cold spots are most likely to form in corners away from the electrodes 152 and 154. The vapor, such as mercury vapor, may convert back to a liquid form in the region of the cold spots thus altering the mercury vapor pressure and the efficiency of the lamp. If the temperature in the chamber 118 is too high, the mercury vapor pressure may increase beyond acceptable values. If the mercury vapor pressure exceeds 50 microns, some of the UV radiation may be absorbed due to a phenomenon known as self-imprisonment. The efficiency of the lamp 100 is decreased if the temperature in the chamber 118 is uncontrolled. Thus, it is desirable to maintain the temperature in the chamber 118 at or near a predetermined temperature so as to maintain the mercury vapor pressure at a desired value.

The lamp 100 includes a temperature regulation system 200 to regulate the temperature within the chamber 118. The temperature control system 200 is illustrated in the schematic diagram of FIG. 4. A heater element 172, shown in FIG. 4 as a resistor, provides resistive heating when supplied with electrical power. A temperature controller 204 is connected in series with a DC supply 202 and the heater element 172. The temperature controller 204 is necessary to prevent the temperature within the chamber 118 from reaching an unacceptably high level. The temperature regulation system 200 illustrated in FIG. 4 also includes a temperature sensor 206, which may be a thermistor or other well known form of temperature sensing element. The temperature sensor 206 is mounted to the bottom of the base 104 using a thermally conductive adhesive. In a preferred embodiment, the temperature sensor 206 is mounted in a corner region of the lamp located away from the electrodes 152 and 154 where cold spots are known to occur. Accordingly, the temperature sensor 206 is mounted in that region and generates a temperature signal indicative of the temperature within the chamber 118. If the temperature in the chamber 118 falls below a predetermined value, the signal from the temperature sensor 206 enables the temperature controller 204, which supplies current from the DC supply 202 to the heater element 172. When the temperature within the chamber 118 rises above a predetermined threshold, the signal from the temperature sensor 206 disables the temperature controller 204. The temperature regulation system 200 enables the lamp 100 (see FIG. 1) to meet military specification benchmarks that require the production of light having an intensity of 5,000 foot-lamberts within five minutes of start up and 10,000 foot-lamberts within 10 minutes of start up. The temperature regulation system 200 can heat the chamber 118 from −40° C. to approximately 52° C. within five minutes.

Figure 4:
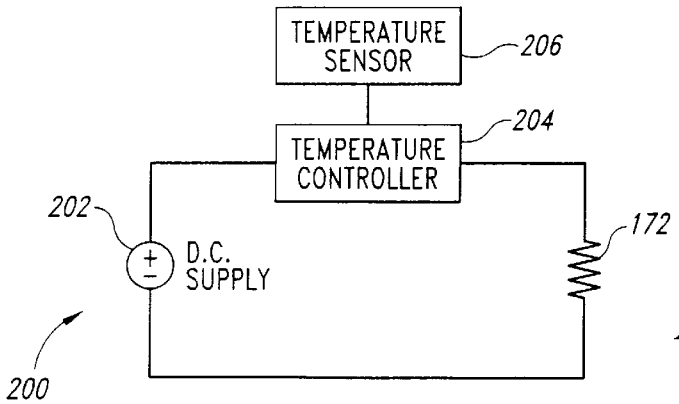
FIG. 4 is a schematic illustrating the operation of a temperature controller in the lamp of FIG. 1.

The temperature controller 204 is illustrated in FIG. 4 as an On-Off type controller. However, those skilled in the art will recognize that other forms of temperature regulation may also be used. For example, a Peltier device or other form of conventional thermoelectric temperature control device can be used to control the temperature in the chamber 118. A fan (not shown) or other cooling device can be used to cool the chamber 118 if the lamp 100 gets too hot.

In a preferred embodiment, the heater element 172 is mounted on the bottom portion of the base 104. As best seen in FIG. 3, the heater element 172 comprises an electric conductor approximately 0.030 to 0.040 inches wide and approximately 100 microns thick. In a preferred embodiment, the heater element 172 is manufactured from a thick film cermet material comprising a silver base mixed with a ceramic material and has a nominal resistance of approximately 13 ohms. The cermet material is applied to the bottom portion of the base 104 in a conventional manner. The heater element 172 is serpentine in shape and is centered below the serpentine channel 140.

The lamp base 104 also includes a pair of spaced apart serpentine conductors 180, which are mounted on opposite sides of the heater element 172. In a preferred embodiment, the serpentine conductors 180 comprise a thick film cermet material having a width of approximately 0.015 inches wide and approximately 40 $\mu$m thick. For convenience in manufacturing, it is possible to apply the thick film circuit for the heater element 172 and the thick film circuit for the serpentine conductors 180 at the same time. In this embodiment, the heater element 172 and the serpentine conductors 180 have the same thickness. The serpentine conductors 180 are separated by approximately 0.2 inches and are centered under the serpentine channel 140. In a preferred embodiment, the conductors are disposed on the base 104 for the entire length of the serpentine channel.

The bottom surface of the lamp base 104 is coated with a material comprising a zinc borosilicate compound. The zinc borosilicate compound is an electrical insulator and covers the heater element 172 and the serpentine conductors 180 to prevent the exposure of bare electrical conductors and possible short circuit when the lamp 100 is in use. The zinc borosilicate compound is also white in color to reflect light generated within the chamber 118 towards the lamp cover 116.

In a first operational mode of the lamp 100, which may also be referred to as a high intensity or day mode, gas within the chamber 118 is ionized on a path along the serpentine channel 140 between the first and second electrodes 152 and 154 to provide a high intensity photoluminescent light. In a second mode of operation, which may also be referred to as a low intensity or night mode, the gas within the chamber 118 is ionized on a path created by an electric field between the serpentine conductors 180 to provide a low-intensity photoluminescent light. Thus, the plasma discharge occurs in a longitudinal fashion along the length of the serpentine channel while the electric field is oriented in a direction substantially perpendicular to the serpentine channel.

In the high intensity mode, the first and second electrodes 152 and 154 are coupled to the power supply $V_{PH}$ and generate a plasma discharge, which travels along the serpentine channel 140 between the first and second electrodes. Thus, the plasma discharge follows a pathway from the compartment 150 through the passageway 162, the getter space 148, the passageway 164, and the serpentine channel 140. As previously described, the plasma discharge produces ultraviolet radiation, which in turn is converted to visible light $L_P$. In the high intensity mode, the serpentine conductors 180 need not be powered. However, if power is temporarily applied to the serpentine conductors, the power supply $V_{PH}$ need only generate the run voltage such that the start voltage is not required. Additional details of this aspect of the lamp 100 are provided below.

The brightness of the lamp 100 in the high intensity mode is controlled in a conventional manner. As is known in the art, the brightness of a lamp is proportional to the current flowing in the plasma discharge. Amplitude modulation (AM) and pulse width modulation (PWM) are two known techniques to vary the current and thus control the brightness of the lamp 100. AM brightness control has the advantage of simplicity in circuit operation, but has the disadvantage of difficulty in starting the lamp at low intensities where the voltage of the power supply $V_{PH}$ may be too low to initiate the plasma discharge. Although PWM brightness control requires greater complexity in the control circuit, the lamp 100 may be readily started at any brightness level. The operation of brightness control circuits is well known in the art, and need not be described in greater detail herein.

In the high intensity mode, the brightness of the lamp can be varied between 250 foot-lamberts and 10,000 foot-lamberts at 50° C. Thus, the lamp 100 provides a high level of illumination, which is useful in applications with a high level of ambient light.

Figure 5:
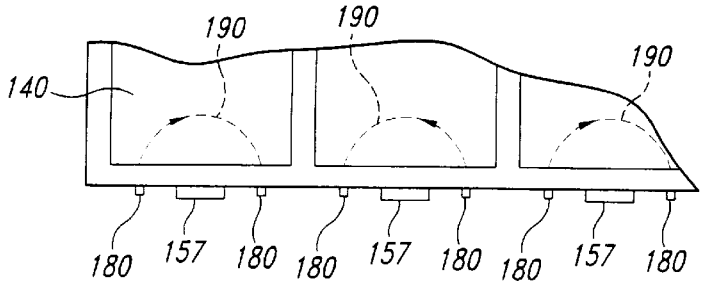
FIG. 5 is an exploded fragmentary side elevational view of the lamp of FIG. 1.

In the low intensity mode of operation, the power supply $V_{PH}$ is inactive and thus no plasma discharge is created between the first and second electrodes 152 and 154. Instead, a power supply $V_{PL}$ (see FIG. 3) supplies an AC signal to the serpentine conductors 180. The power supply $V_{PL}$ is a conventional AC power supply for photoluminescent lamps. In a preferred embodiment, the power supply $V_{PL}$ provides 1,800 volts RMS at 20 milliamperes (mA). The serpentine conductors 180 act as two plates of a capacitor and the electric field created between the two capacitive elements (i.e., the serpentine conductors 180) creates a capacitive coupling discharge within the serpentine chamber 140. This is illustrated in FIG. 5 where the AC voltage on the serpentine conductors 180 creates an electric field 190 within each of the sections of the serpentine channel 140. Because the current generated with electric field 190 extends through the chamber 118, the gas within the chamber reacts with the electric field 190 and produces UV radiation in response thereto. The UV radiation from the is converted to visible light by the fluorescent layer 168 (see FIG. 2).

Because the current generated by electric field 190 is significantly lower than the current in the plasma discharge, the brightness level produced within the lamp 100 is significantly decreased in the low intensity mode. In the low intensity mode, the lamp 100 produces visible light $L_P$ in a range from 0.5 to 200.0 foot-lamberts. The brightness of the lamp 100 in the low intensity mode can also be controlled through conventional techniques, such as AM and PWM.

As previously noted, a conventional gas discharge lamp power supply must provide the start voltage and the run voltage. However, the power supply $V_{PH}$ of the lamp 100 need only generate the lower level run voltage if the power supply $V_{PL}$ is temporarily activated when initially applying power to the lamp 100 in the high intensity mode. The power supply $V_{PL}$ generates the electric field 190 in the manner described above, which effectively preionizes the gas in the chamber 118 (see FIG. 1). This preionization process decreases the voltage required to establish the plasma discharge between the electrodes 152 and 154. The power supply $V_{PH}$ can be designed for operation at the run voltage, thus increasing efficiency and reducing the cost of the power supply.

If the power supply $V_{PH}$ is an AC supply, the frequencies of operation of the power supplies $V_{PH}$ and $V_{PL}$ must be different and nonharmonically related. If the power supplies $V_{PH}$ and $V_{PL}$ are both PWM controlled, a simple synchronization technique is to make sure that the power supplies are not on at the same time. That is, if the power supply $V_{PH}$ has, by way of example, a 75% duty cycle (i.e., on 75% of the time and off 25% of the time), the power supply $V_{PL}$ can be turned on during the period when the power supply $V_{PH}$ is off. This synchronization process avoids the possible generation of beat frequencies that reduce the efficiency of the lamp 100 and may result in non-uniform brightness. No synchronization is required if the power supply $V_{PH}$ is a DC supply.

In the high intensity mode, the plasma discharge produces a sufficient temperature inside the chamber 118 such that the mercury is generally present in the form of a gas vapor. However, in the low intensity mode, the temperature may be too low for the mercury to exist in the vapor phase, causing the mercury to pool in liquid form in cold spots of the chamber 118, as discussed above. Under these circumstances, the electric field 190 may excite argon gas within the chamber 118 and produce an off-white or pink color. To avoid this problem, the temperature regulation system 200 provides power to the heater element 172, which warms the chamber 118 and converts the mercury from a liquid phase to a vapor phase, thus ensuring uniformity in the bandwidth of the light in both the low and high intensity modes.

Figure 6:
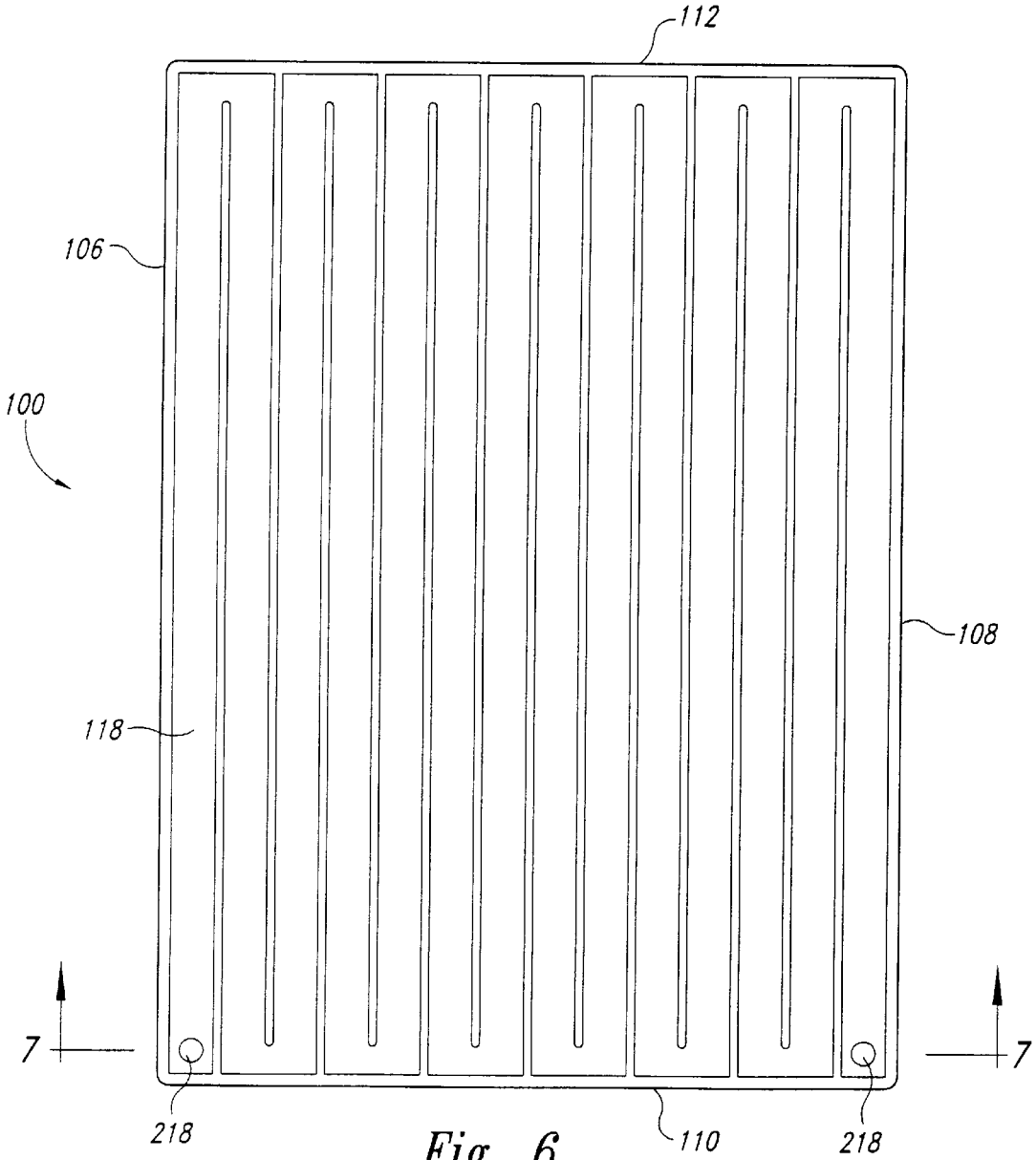
FIG. 6 is a top plan view of an alternative embodiment of the present invention.
Figure 7:
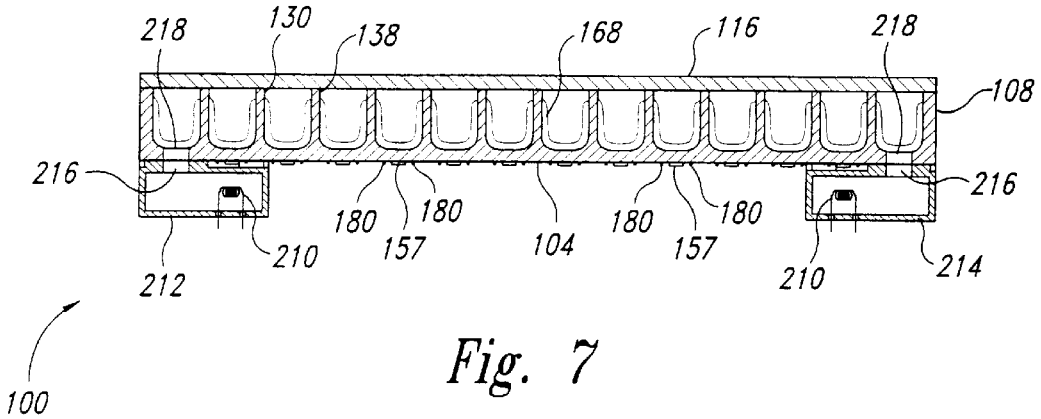
FIG. 7 is a side elevational view of the lamp of FIG. 6 taken along the line 7—7.
Figure 8:
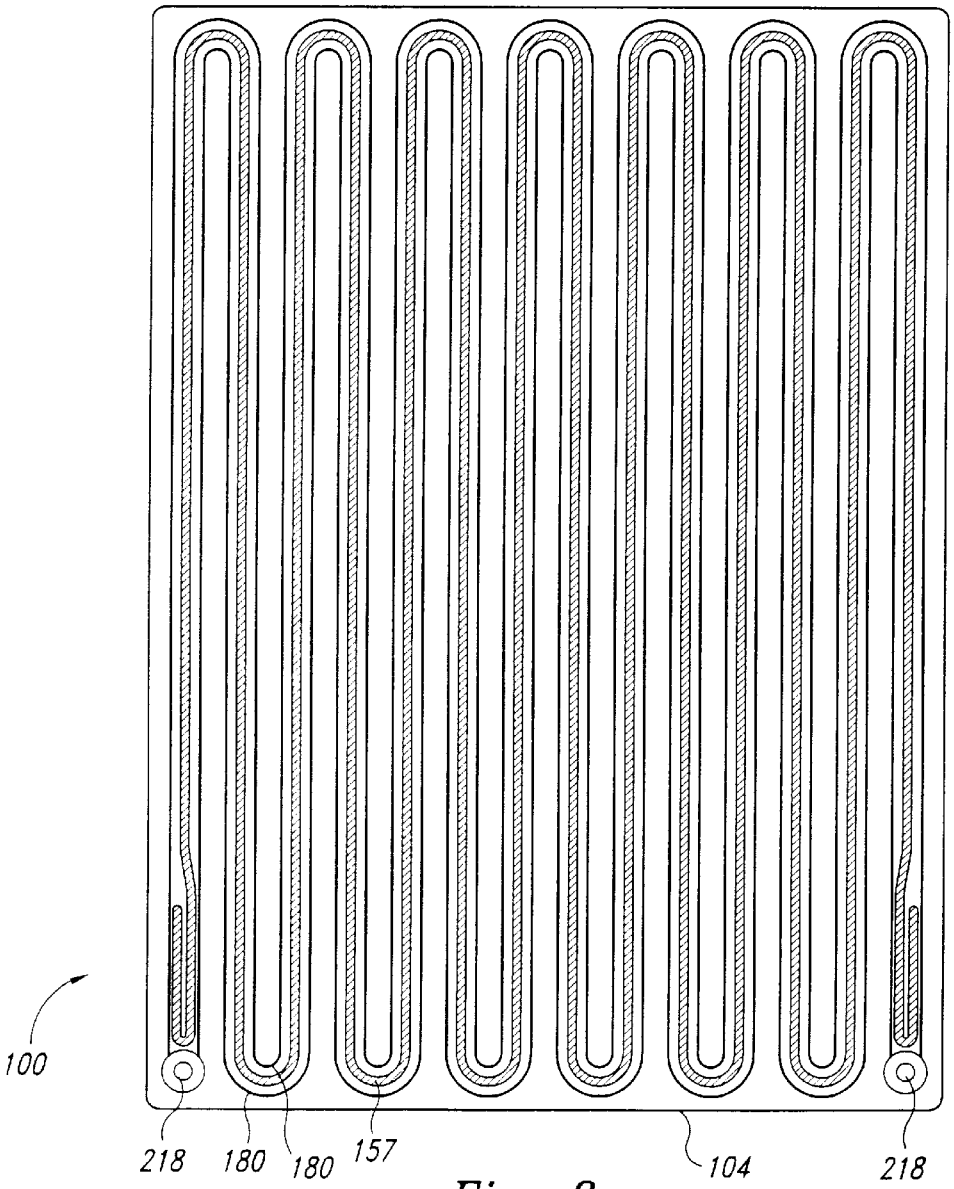
FIG. 8 is a bottom plan view of the lamp of FIG. 6.

FIGS. 1–3 illustrate the operation of the lamp 100 with internal electrodes of the cold cathode type. However, it should be clear that the principles of the present invention may be readily applied to other embodiments of the lamp 100. For example, FIGS. 6–8 illustrate an embodiment of the lamp 100 with external hot cathode type electrodes 208 and 210, which are contained within external electrode modules 212 and 214, respectively. The first and second electrodes 208 and 210 are coupled to the power supply $V_{PH}$ (see FIG. 1) and receive electrical power therefrom. In the high intensity mode, the plasma discharge is established in the serpentine channel 140 between the first and second hot cathode type electrodes 208 and 210 in response to the application of power from the power supply $V_{PL}$.

The electrode modules 212 and 214 are bonded, using conventional glass solder techniques, to the base 104 of the lamp 100. When the electrode modules 212 and 214 are bonded to the lamp base 104, apertures 216 in the electrode modules are in alignment with and communicate with corresponding apertures 218 in the base 104. The apertures 216 and 218 permit the equalization of vacuum within the serpentine channel 140 and the electrode modules 212 and 214. In addition, the aligned apertures 216 and 218 permit the flow of the plasma discharge between the first and the second hot cathode type electrodes 208 and 210 along the serpentine channel 140. The heater element 157 and serpentine conductors 180 operate in the manner described above when the lamp 100 is in the low intensity mode.

In yet another alternative embodiment, the cold cathode type internal electrodes 152 and 154 (see FIG. 1) can be replaced by internal hot cathode type electrodes. In yet another alternative embodiment, the external hot cathode type electrodes 208 and 210 are replaced by external cold cathode type electrodes. A combination of hot and cold cathode types may also be used in accordance with the principles of the present invention.

Figure 9:
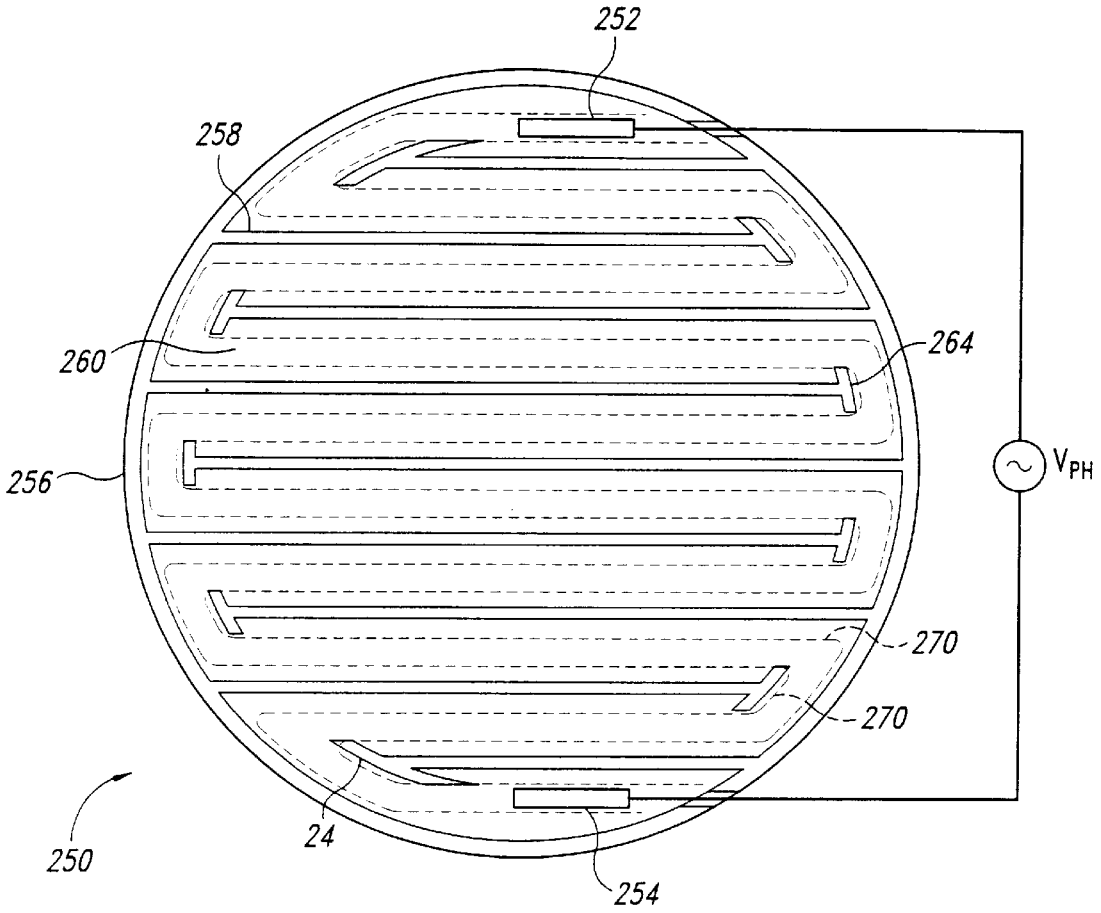
FIG. 9 is a top plan view of another alternative embodiment of the present invention.

FIGS. 1–8 illustrate various embodiments of the present invention with a flat rectangular shaped lamp 100. However, the principles of the present invention may be applied to lamps of differing shapes, such as a round lamp 250, as shown in FIG. 9. First and second electrodes 252 and 254, which may be cold cathode or hot cathode type electrodes, are contained within the lamp 250. A circular wall 256 includes a plurality of internal walls 258 to define a serpentine channel 260. A first end of each internal wall 258 is coupled to the circular wall 256. A second end of each internal wall 208 terminates a short distance from the circular wall 206. A curved deflection member 264 at the terminating end of each internal wall 208 serves to guide the plasma discharge to the center of the serpentine channel 260. The shape of the curved deflection members 214 may be altered to accommodate the curvature of the curved wall 206. In the high intensity mode, the power supply $V_{PH}$ supplies electrical power to the first and second electrodes 252 and 254. As previously discussed, the power supply $V_{PH}$ may be an AC power supply or a DC power supply.

The round lamp 250 also includes a heater element (not shown) on the bottom external surface of the lamp. The heater element is serpentine in shape and is substantially centered under the serpentine channel 260. In addition, a pair of serpentine conductors 270 are disposed on opposite sides of the heater element 268 and also substantially follow the serpentine channel 260. In a preferred embodiment, the serpentine conductors 270 are disposed along substantially the entire length of the serpentine channel 260.

For operation in the low intensity mode, the power supply $V_{PH}$ is disabled and the power supply $V_{PL}$, which is an AC power supply, is activated to supply power to the serpentine conductors 270. In response to the AC voltage on the serpentine conductors 270, an electric field is generated within the interior portion of the lamp 250 between the serpentine conductors 270 along the serpentine channel 260. In addition, the heater element 268 is connected to the DC power supply (see FIG. 4) to heat the internal portion of the lamp 200.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A planar photoluminescent lamp having first and second modes of operation, the lamp comprising:

a lamp body having a plurality of sidewalls and endwalls and a base;

a lamp cover mounted to the lamp body such that the lamp body and the cover define a chamber having a channel length extending from a first end to a second end, the lamp having an outer surface;

first and second electrodes in proximity with the first and second ends, respectively, to produce an electrical discharge therebetween when supplied with electrical power in the first mode of operation, the electrical discharge occurring along the channel length between the first and second electrodes;

first and second electrical conductors mounted on the same outer surface of the lamp along at least a portion of the channel to generate an electric field therebetween when supplied with electrical power in the second mode of operation, the electric field having an orientation between the first and second electrical conductors in a direction substantially perpendicular to the channel length;

a gas within the chamber to emit ultraviolet energy in response to the electrical discharge, the gas emitting a first quantity of ultraviolet energy in response to the electrical discharge along the channel length in the first mode of operation and emitting a second quantity of ultraviolet energy less than the first quantity of ultraviolet energy in response to the electric field generated by the first and second electrical conductors; and a photoluminescent material within the chamber to produce visible light in response to the ultraviolet energy.

2. The lamp of claim 1, wherein the first and second electrical conductors are spaced apart at a substantially constant spacing along the serpentine channel.

3. The lamp of claim 2, further including a guide member at the end portion of at least some of the channel walls, the guide member guiding the electrical discharge to a central portion of the serpentine channel.

4. The lamp of claim 1, further including a temperature control system located outside the chamber to control the temperature within the chamber.

5. The lamp of claim 4 wherein the temperature control system comprises a resistive material mounted on the outside portion of the lamp body along at least a portion of the channel length, the resistive material generating heat in response to the application of electrical power thereto.

6. The lamp of claim 4, further including a temperature sensing component mounted on the outside portion of the lamp body to sense temperature within the chamber, the temperature sensing component generating a temperature signal indicative of temperature within the chamber, the temperature signal controlling the application of electrical power to the resistive material.

7. The lamp of claim 4 wherein the electrical power applied to the resistive material is direct current (DC) power.

8. The lamp of claim 1 wherein the first and second electrical conductors are distributed along the entirety of the channel length.

9. The lamp of claim 1 wherein the first and second electrical conductors are substantially parallel with respect to each other along the portion of the channel length.

10. The lamp of claim 1 wherein the first and second electrodes are a hot cathode type.

11. The lamp of claim 1 wherein the first and second electrodes are a cold cathode type.

12. The lamp of claim 1 wherein the first and second electrodes are mounted internally within the chamber.

13. The lamp of claim 1, further including first and second electrode modules containing the first and second electrodes, the first and second electrode modules being externally mounted outside the chamber.

14. The lamp of claim 1 wherein operation of the lamp in the first mode is initiated by applying electrical power to the first and second electrodes and temporarily applying the AC electrical power to the first and second electrical conductors mounted on an outside portion of the lamp body.

15. The lamp of claim 14, further including an AC power supply to supply the electrical power to the first and second electrodes in the first mode of operation.

16. The lamp of claim 14, further including a direct current (DC) power supply to supply the electrical power to the first and second electrodes in the first mode of operation.

17. A gas-filled planar photoluminescent lamp containing a photoluminescent material to emit visible light when the gas emits ultraviolet energy, the lamp comprising:

a lamp body;

a lamp cover mounted to the lamp body such that the lamp body and the cover define a chamber having a channel length extending from a first end to a second end, the lamp having an outer surface;

a first electrode mounted in proximity with the first end;

a second electrode mounted in proximity with the second end, said first and second electrodes configured to produce a plasma discharge therebetween along the channel length when supplied with electrical power, the photoluminescent material to emitting visible light when the gas emits ultraviolet energy in response to the plasma discharge; and first and second electrical conductors mounted on the same outer surface of the lamp outside the chamber and distributed along at least a portion of the channel length, the first and second electrical conductors generating an electric field throughout the portion of the channel length and in a direction substantially perpendicular to the channel length when supplied with electric power, the photoluminescent material to emitting visible light when the gas emits ultraviolet energy in response to the electric field.

18. The lamp of claim 17, further including a temperature control system located outside the chamber to control the temperature within the chamber.

19. The lamp of claim 18 wherein the temperature control system comprises a resistive material mounted on the outside portion of the lamp body along at least a portion of the channel length, the resistive material generating heat in response to the application of electrical power thereto.

20. The lamp of claim 18, further including a temperature sensing component mounted on the outside portion of the lamp body to sense temperature within the chamber, the temperature sensing component generating a temperature signal indicative of temperature within the chamber, the temperature signal controlling the application of electrical power to the resistive material.

21. The lamp of claim 17 wherein the electrical power applied to the resistive material is direct current (DC) power.

22. The lamp of claim 17 wherein the electrical power applied to the first and second electrodes is direct current (DC) electrical power.

23. The lamp of claim 17 wherein the electrical power applied to the first and second electrodes is alternating current (AC) electrical power.

24. The lamp of claim 17 wherein the plasma discharge between the first and second electrodes is initially established by applying electrical power to the first and second electrodes and applying alternating current (AC) electrical power to the first and second electrical conductors outside the chamber.

25. The lamp of claim 24, further including an alternating current (AC) power supply to supply the electrical power to the first and second electrodes.

26. The lamp of claim 24, further including a direct current (DC) power supply to supply the electrical power to the first and second electrodes.

27. The lamp of claim 17 wherein the electrical power applied to the first and second electrical conductors is alternating current (AC) electrical power.

28. The lamp of claim 17 wherein the first and second electrical conductors are distributed along the entirety of the channel length.

29. The lamp of claim 17 wherein the first and second electrical conductors are substantially parallel with respect to each other along the portion of the channel length.

30. The lamp of claim 17 wherein the first and second electrodes are a hot cathode type.

31. The lamp of claim 17 wherein the first and second electrodes are a cold cathode type.

32. The lamp of claim 17 wherein the first and second electrodes are mounted internally within the chamber.

33. The lamp of claim 17, further including first and second electrode modules containing the first and second electrodes, the first and second electrode modules being externally mounted outside the chamber.

* * * * *